US006036602A

United States Patent [19]

Abbott

[11] Patent Number: 6,036,602

[45] Date of Patent: Mar. 14, 2000

[54] FULL CONTACT MARTIAL ARTS SPARRING INSTRUMENT

[76] Inventor: Dana G. Abbott, 4905 E. Beverly La., Phoenix, Ariz. 85032

[21] Appl. No.: 09/274,543

[22] Filed: Mar. 23, 1999

[51] Int. Cl.[7] ..... F41A 33/00; A63H 33/30

[52] U.S. Cl. ..... 463/47.2; 463/47.7; 482/12

[58] Field of Search ..... 463/47.2, 47.6, 463/47.7; 482/12, 109

[56] References Cited

U.S. PATENT DOCUMENTS 1,986,682 1/1935 Schulz .
4,957,057 9/1990 Marcucci .
5,295,926 3/1994 Tanabe .
5,324,227 6/1994 Yuh-Ching .
5,630,998 5/1997 Parsons .

*Primary Examiner*—William M. Pierce
*Attorney, Agent, or Firm*—Frank J. McGue

[57] ABSTRACT

A sparring instrument is disclosed which allows for safe, pain free, full contact training. The sparring instrument comprises a handle and a striking portion having a bushing armature mounted thereto. The bushing armature comprises a tip rod telescopically received within a plurality of telescopically mounted cylinders. The bushing armature is covered by a sheath extending beyond the tip rod. The sheath is covered by a soft, flexible material to its end. The sheath is made of a soft, resilient material whereby the sheath extends from the end of the soft, flexible material when the instrument is bent.

18 Claims, 2 Drawing Sheets

FULL CONTACT MARTIAL ARTS SPARRING INSTRUMENT

TECHNICAL FIELD

This invention relates in general to martial arts devices, and, more particularly, to a durable, full contact martial arts sparring instrument which allows for safe, pain free, full contact training.

BACKGROUND OF THE INVENTION

For thousands of years man has flailed and slashed cutting weapons to defend and protect. These weapons include, but are not limited to, knives, short and long swords, sticks, batons, staffs, spears, and nunchaku. However, during the learning process, use of such instruments can be very dangerous for both the trainee and teacher. Thus, training instruments are employed to minimize the dangers. For example, wooden swords having blunt points are often substituted for the real item. However, even the blunted swords can cause injury, such as bruises, even when used properly. Often protective gear is worn to further prevent injury. For example, in kendo, heavy and cumbersome protective equipment evolved to provide protection to the combatants.

However, over thirty years ago, Kaicho Tanabe Tetsundo and his group of swordsman created a new style of swordplay initially called Goshindo, later renamed Sports Chanbara. This Chanbara style of martial arts was very traditional but employed the use of more modern materials such as rubbers and plastics to develop a sword called the AirSoft™ Kodachi which employs an adjustable air filled bladder in the body of the sword to prevent injury to the combatants. The development of the Kodachi allowed combat with only a light head mask to protect the face and eyes. This new style of martial arts has become the fastest growing combative sport in Japan and is recognized by Japanese Department of Education.

However, the traditional Kodachi weapons of Sports Chanbara are generally hand made, work ntensive and very expensive because of the use of the air bladder. Thus, there is a need for a device which is simple to manufacture, durable and safe to use in martial arts training, and, more particularly, to substitute for the traditional Kodachi.

None of the known prior art disclose the device set forth herein.

SUMMARY OF THE INVENTION

It is an object of this invention to provide a simple, easy to manufacture sparring instrument for use in martial arts training.

It is a further object of this invention to provide a durable, safe sparring instrument for use in martial arts training.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

A device 10 of the present invention, as seen in FIGS. 1–4, comprises a handle 12 and a striking portion 14 separated by a guard 16. Those skilled in the art of Chanbara will recognize that the illustrated device of FIGS. 1–4 is known as a Kodachi or short sword. However, the principles of the invention are applicable to other striking instruments as, for example, the Choken or long sword illustrated in FIG. 5. Other striking instruments which incorporate the present invention are a Shoto (12 inch knife), a Tanto (18 inch knife), Escrima (baton), Yari (spear), Bo (6 foot double ended staff) or Jo (4–5 foot double ended staff).

Figures 1, 2, 3:
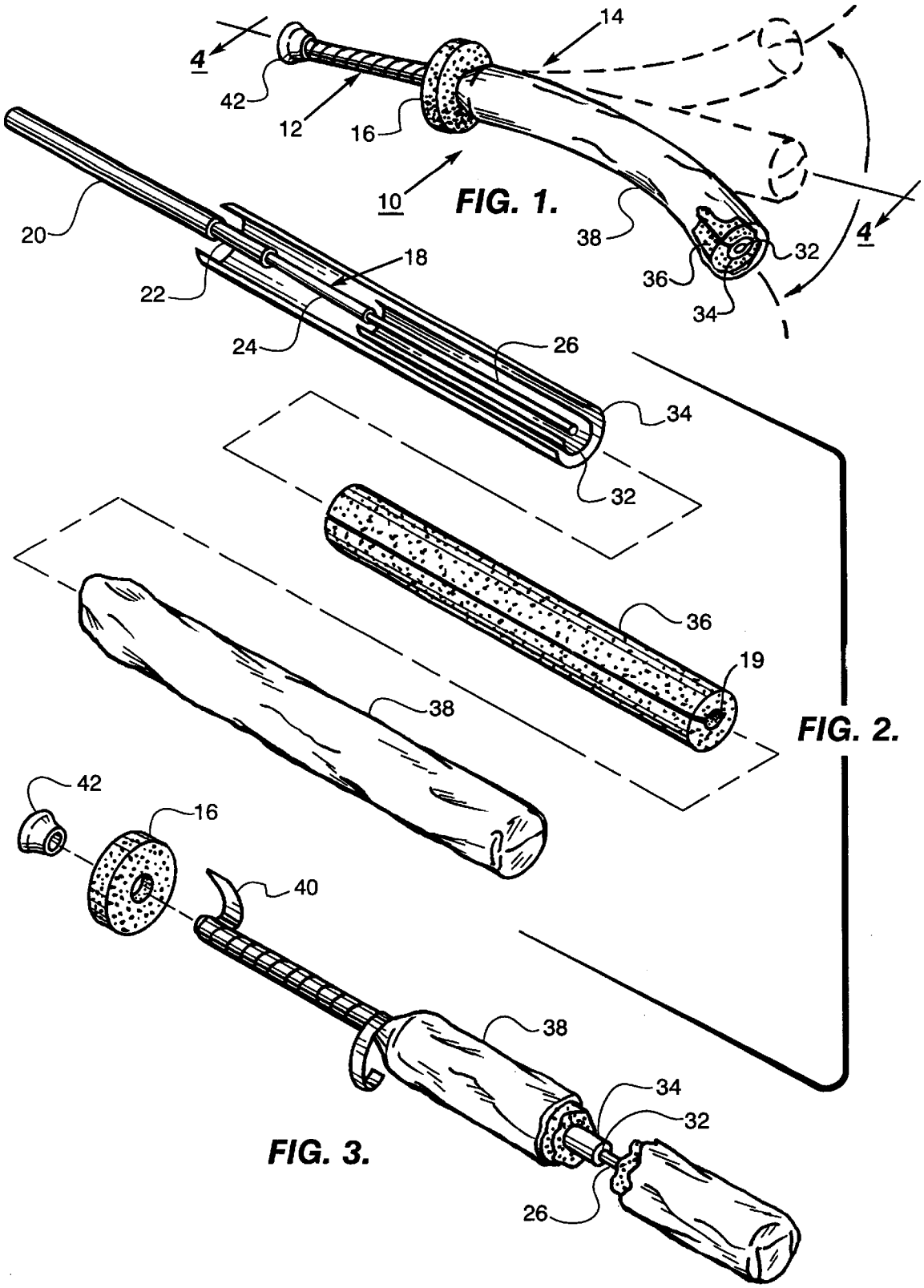
FIG. 1 is a perspective view of the present device showing its flexibility in use.
FIG. 2 is a perspective exploded view of the device of FIG. 1.
FIG. 3 is a perspective, partially exploded and partially cut away view of the device of FIG. 1.
Figure 4:
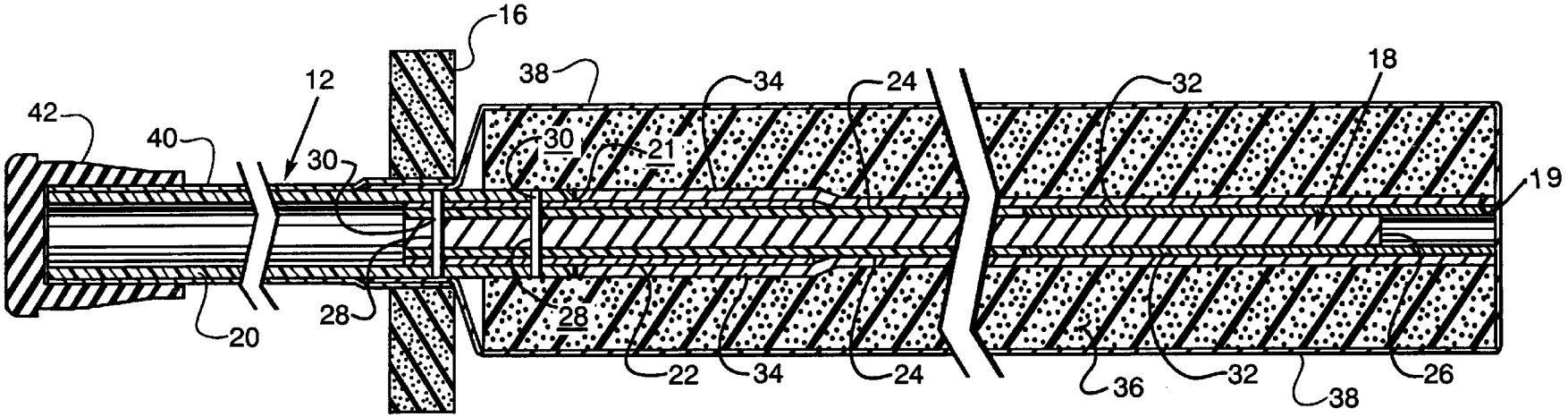
FIG. 4 is a side cross sectional view of the device of FIG. 1 taken along line 4—4.

Device 10 incorporates a piston-flex mechanism in utilizing a bushing armature 18 which readily moves through a cylindrical cavity 19 when device 10 is struck on a solid object. As best seen in FIGS. 2 and 4, bushing armature 18 comprises a handle cylinder 20, a first intermediate cylinder 22 telescopically received within a mouth 21 of handle cylinder 20, a second intermediate cylinder 24 telescopically received within first intermediate cylinder 22 and a tip rod 26 which is telescopically received within second intermediate cylinder 24. As best seen in FIG. 4, the ends of first intermediate cylinder 22, second intermediate cylinder 24 and tip rod 26 telescopically received within handle cylinder 20 are co-terminus therein.

In the preferred embodiment, two holes 28 are drilled through the overlapping portions of handle cylinder 20, intermediate cylinders 24 and 26 and tip rod 26 and two tap and lock pins 30 inserted therethrough to secure the assembly together. Those skilled in the art will recognize that alternate methods of assuring the structural integrity of bushing armature 18 are possible, including, but not limited to, adhesives, screws, rivets, or ultrasonic welding.

In one preferred embodiment of device 10, bushing armature 18 is twenty two inches (56 cm) long. Tip rod 26 is 16 inches (40 cm) in length and 0.250 inches (0.635 cm) in diameter, second intermediate cylinder 24 is eight inches (20 cm) long, 0.250 inches (0.635 cm) inner diameter and 0.375 inches (0.9525 cm) outer diameter, first intermediate cylinder 22 is four inches (10 cm) long with a 0.375 inch (0.9525 cm) inner diameter and 0.500 inches (1.27 cm) outer diameter and handle cylinder 20 is eight inches (20 cm) long, 0.500 inches (1.27 cm) inner diameter and 0.750 inches (1.905 cm) outer diameter. With the co-terminus ends of tip rod 26 and intermediate cylinders 24 and 26 extending two inches (5 cm) into handle cylinder 20 from mouth 21, first intermediate cylinder 22 extends two inches (5 cm) from handle cylinder 20, second intermediate cylinder 24 extends 4 inches (10 cm) from first intermediate cylinder 22 and tip rod 26 extends eight inches (20 cm) from second intermediate cylinder 24. In this embodiment, holes 28 are drilled 0.750 inches (1.905 cm) and 1.5 inches (3.8 cm) from mouth 21 of handle cylinder 20 receiving the co-terminus end of intermediate cylinders 22, 24 and tip rod 26. In this preferred embodiment, handle cylinder 20, intermediate cylinders 22 and 24 and tip rod 26 are all manufactured from nylon material having a tensile strength of 11,600 psi, a flexural strength of 15,700 psi and impact strength of 2.5 ft.-lb./in. One such material is Ensilon® 6 available from Ensinger Engineering Plastics of Washington, Pa.

Figure 5:
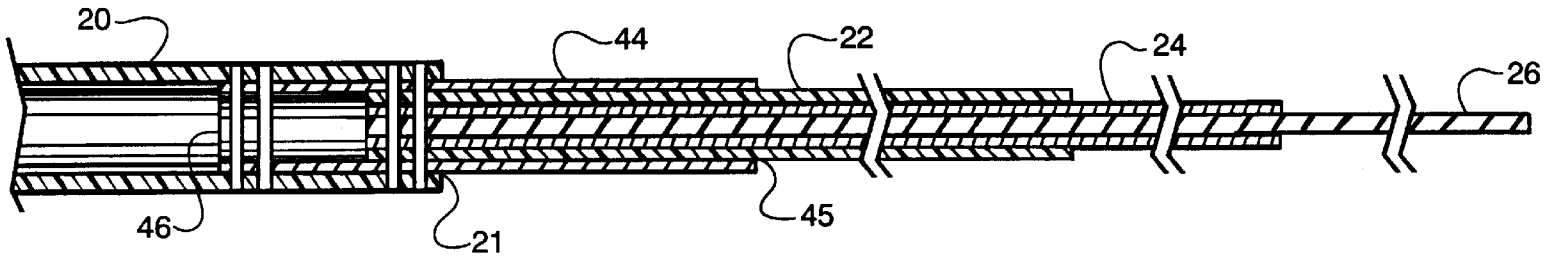
FIG. 5 is a side cross sectional view of an alternate embodiment of a bushing armature employed in the present invention.

In still another preferred embodiment of a Choken device 10 which is best seen in FIG. 5, bushing armature 18 is thirty eight inches (96.5 cm) long and employs an extender cylinder 44 mounted between first intermediate cylinder 22 and handle cylinder 20. As best seen in FIG. 5, bushing armature 18 comprises handle cylinder 20, first intermediate cylinder 22 telescopically received within a first mouth 45 of extender cylinder 44, second intermediate cylinder 24 telescopically received within first intermediate cylinder 22 and a tip rod 26 which is telescopically received within second intermediate cylinder 24. Similar to the embodiment of FIG. 4, the ends of first intermediate cylinder 22, second intermediate cylinder 24 and tip rod 26 telescopically received within extender cylinder 44 and are co-terminus therein. A second mouth 46 of extender cylinder 44 is telescopically received within mouth 21 of handle cylinder 20.

In the preferred embodiment of FIG. 5, a first pair of holes 28 are drilled through the overlapping portions of extender cylinder 44 and intermediate cylinders 24 and 26 and tip rod 26 and two tap and lock pins 30 inserted therethrough to secure the assembly together. A second pair of holes 28 are drilled through the overlapping portions extender cylinder 44 and handle cylinder 20 and tow tap and lock pins 30 inserted therethrough. Those skilled in the art will recognize that alternate methods of assuring the structural integrity of bushing armature 18 are possible, including, but not limited to, adhesives, screws, rivets, or ultrasonic welding.

In the Choken embodiment of FIG. 5, tip rod 26 is 20 inches (50.8 cm) in length and 0.250 inches (0.635 cm) in diameter, second intermediate cylinder 24 is twelve inches (30 cm) long, 0.250 inches (0.635 cm) inner diameter and 0.375 inches (0.9525 cm) outer diameter, first intermediate cylinder 22 is six inches (15 cm) long with a 0.375 inch (0.9525 cm) inner diameter and 0.500 inches (1.27 cm) outer diameter, extender cylinder 44 is 10 inches (25 cm) long with a 0.500 (1.27 cm) inner diameter and 0.75 (1.905 cm) outer diameter, and handle cylinder 20 is 12 inches (30 cm) long, 0.750 inches (1.905 cm) inner diameter and 1.0 inches (2.54 cm) outer diameter.

As best seen in FIG. 2, a sheath comprises a first polyethylene strip 32 and a second polyethylene strip 34. First polyethlene strip 32, preferably 10 inches (25 cm) long by 2 inches (5 cm) wide and ⅛ inch thick (0.3 cm), is roll wrapped around that portion of bushing armature 18 running from the exposed end of second intermediate cylinder 24 and extending two inches (5 cm) beyond the end of tip rod 26. Second polyethylene strip 34, preferably about 16 inches (50 cm) by 2 inches (5 cm) by ⅛ inch thick (0.3 cm), is roll wrapped around bushing armature 18 and first polyethylene strip 32 from the exposed end of second intermediate cylinder 24 to the end of the first polyethylene strip 32. The corresponding lengths for the choken device 10 of FIG. 5 are 10 inches (25 cm) for strip 32 and 20 inches (50 cm) for strip 34.

Polyethylene strips 32 and 34 provide the sheath which provides superior flexing capability and reduces vibration, friction and breakage. However, the most important function of strips 32 and 34 is safety. As shown in FIG. 1, the extra two inches that strips 32 and 34 extend beyond the end of bushing armature 18 act as a soft buffer when Kodachi 10 is bent when striking or stabbing an object. Strips 32 and 34 then retract into cavity 19 when device 10 rebounds to the straight position. The piston action created by the in and out movement of strips 32 and 34 provides safety as does the air bladder of the prior art but without the complexity of the air bladder system.

The now wrapped bushing armature 18 is inserted into a thick polyethylene cylinder 36 which defines cavity 19 and which provides the softness needed for safe striking. One end of cylinder 36, in the straight position, is coterminus with the tip of strips 32 and 34. The other end of cylinder 36 ovelaps handle cylinder 20 by, preferably, two inches (5 cm) and is glued thereon. Cylinder 36 is preferably inserted into a soft nylon slip 38 which is tied off about 2.50 (6.35 cm) from mouth 21 and preferably glued thereon.. This assembly forms striking portion 14.

To form handle 12, a cloth tape 40 is would about handle cylinder 20. Such cloth tape 40 provides a suitable gripping surface for a user. Guard 16 which is an annulus is slipped over handle cylinder 20 and is mounted in contact with striking portion 14. A cap 42 is secured to the end of handle cylinder 20 opposite mouth 21.

Although only certain embodiments have been illustrated and described, namely, the Kodachi and Choken devices, it will be apparent to those skilled in the art that various changes and modifications may be made therein without departing from the spirit of the invention or from the scope of the appended claims. For example, double ended staffs known as Bo or Jo can be made by providing a midpoint handle 12 having two striking portions 14 extending in opposite directions therefrom. Also, shorter shoto or tanto knives or longer yari spears are manufactured by shrinking proportionately the length of the kodachi elements or lengthening proportionally the choken elements, respectively.

What is claimed is:

1. A sparring instrument which allows for safe, pain free, full contact training comprises a handle and a striking portion mounted thereto, the striking portion having a bushing armature comprising a tip rod telescopically received within a plurality of telescopically mounted cylinders, the bushing armature being covered by a sheath, the sheath being covered by a soft, flexible material to the end of said sheath, the sheath extending from the end of the soft, flexible material when the striking portion is bent.

2. The device of claim 1 having a guard mounted between the handle and the striking portion.

3. The device of claim 1 wherein the sheath comprises a plurality of roll wrapped polyethylene strips.

4. The device of claim 1 wherein the handle includes a cloth tape for the outer surface of the handle to aid in gripping same.

5. The device of claim 1 wherein the plurality of telescoping cylinders is three telescoping cylinders, a handle cylinder, a first intermediate cylinder telescopically received within a mouth of the handle cylinder, and a second intermediate cylinder telescopically received within the first intermediate cylinder, the tip rod being telescopically received within the second intermediate cylinder.

6. The device of claim 5 wherein the ends of the first intermediate cylinder, the second intermediate cylinder and the tip rod are telescopically received within the handle cylinder and are co-terminus therein.

7. The device of claim 6 wherein two holes are drilled through the overlapping portions of the handle cylinder, the intermediate cylinders and the tip rod and two tap and lock pins inserted therethrough to secure the assembly together.

8. The device of claim 5 wherein the bushing armature is twenty two inches long.

9. The device of claim 1 wherein the plurality of telescoping cylinders is four telescoping cylinders, a handle cylinder, an extender cylinder telescopically received within the handle cylinder, a first intermediate cylinder telescopically received within a mouth of the extender cylinder, and a second intermediate cylinder telescopically received within the first intermediate cylinder, the tip rod being telescopically received within the second intermediate cylinder.

10. The device of claim 9 wherein the ends of the first intermediate cylinder, the second intermediate cylinder and the tip rod are telescopically received within the extender cylinder and are co-terminus therein.

11. The device of claim 10 wherein two holes are drilled through the overlapping portions of the extender cylinder, the intermediate cylinders and the tip rod and two tap and lock pins inserted therethrough to secure the assembly together.

12. The device of claim 9 wherein the soft, flexible material is polyethylene used for the center elongated piston.

13. The device of claim 1 manufactured from nylon having a tensile strength of 11,600 psi, a flexural strength of 15,700 psi and impact strength of 2.5 ft.-lb./in.

14. The device of claim 1 wherein the soft, flexible material is polyethylene.

15. A sparring instrument which allows for safe, pain free, full contact training comprises a handle and a striking portion mounted thereto and a guard mounted between the handle and the striking portion, the striking portion having a nylon bushing armature comprising a tip rod telescopically received within at least three telescopically mounted cylinders, a handle cylinder, a first intermediate cylinder telescopically received within a mouth of the handle cylinder, and a second intermediate cylinder telescopically received within the first intermediate cylinder, the tip rod being telescopically received within the second intermediate cylinder, the bushing armature being covered by a sheath, the sheath comprising a plurality of roll wrapped strips extending beyond the end of the tip rod, the sheath being covered by a polyethylene cover to the end of said sheath, the sheath extending from the end of the polyethylene cover when the instrument is bent, the handle having a cloth tape for the outer surface thereof to aid in gripping same.

16. The device of claim 15 wherein the ends of the first intermediate cylinder, the second intermediate cylinder and the tip rod are telescopically received within the handle cylinder and are co-terminus therein.

17. The device of claim 15 further comprising an extender cylinder mounted between the handle cylinder and the first intermediate cylinder.

18. The device of claim 17 wherein the ends of the first intermediate cylinder, the second intermediate cylinder and the tip rod are telescopically received within the extender cylinder and are co-terminus therein.

* * * * *